US006554532B1

(12) United States Patent
Mötz et al.

(10) Patent No.: US 6,554,532 B1
(45) Date of Patent: Apr. 29, 2003

(54) DEVICE FOR EARTH PACKING HAVING AT LEAST ONE VIBRATING ROLLER

(75) Inventors: Karl Hermann Mötz, Norterhausen (DE); Uwe Blancke, Koblenz (DE)

(73) Assignee: Bomag GmbH & Co. OHG, Boppard (DE)

( * ) Notice: Subject to any disclaimer, the term of this patent is extended or adjusted under 35 U.S.C. 154(b) by 0 days.

(21) Appl. No.: 09/643,474

(22) Filed: Aug. 22, 2000

(30) Foreign Application Priority Data

Aug. 25, 1999 (DE) ..... 299 14 838 U

(51) Int. Cl.[7] ..... E01C 19/28

(52) U.S. Cl. ..... 404/117; 404/103; 404/121; 404/124

(58) Field of Search ..... 404/102, 103, 404/117, 121, 122, 124, 128; 172/518, 536, 537, 538, 540, 548; 301/5.1, 43

(56) References Cited

U.S. PATENT DOCUMENTS

| | | | | |
|---|---|---|---|---|
| 1,284,385 A | * | 11/1918 | Linden | 301/43 |
| 1,624,734 A | | 4/1927 | Hunt | |
| 1,719,676 A | * | 7/1929 | Soseman | 404/121 |
| 3,071,050 A | | 1/1963 | Shatto | |
| 3,814,531 A | * | 6/1974 | Carnahan et al. | 404/117 |
| 4,164,190 A | * | 8/1979 | Newman | 111/200 |
| 4,278,368 A | * | 7/1981 | Livesay | 404/117 |
| 4,568,218 A | * | 2/1986 | Orzal | 404/117 |
| 6,379,081 B1 | * | 4/2002 | Barbulescu | 404/124 |

FOREIGN PATENT DOCUMENTS

DE 196 48 593 A1 6/1998

OTHER PUBLICATIONS

"Roads and Streets", publication; Jan. 1952.*
"Adams Tamping Rollers", publication; Nov. 1941.*
"German" publication (p. 6); Jun. 1938.*

* cited by examiner

*Primary Examiner*—Heather Shackelford
*Assistant Examiner*—Sunil Singh
(74) *Attorney, Agent, or Firm*—Baker & Hostetler LLP

(57) ABSTRACT

The invention concerns a device for ground compacting, having at least one vibrating roller whose casing surface is composed of a plurality of segments in the peripheral direction, at least some of which have midpoints which describe an arc having a radius of curvature that deviates from the mean radius of the roller. In order to smooth the jolting movement resulting from the shape of the rollers in devices of this type, it is proposed to construct the tire casing of the roller from several sections lying adjacent to one another in the axial direction, said sections having segments abutting one another in the peripheral direction, whereby the abutting edges are displaced vis-à-vis one another in the peripheral direction.

15 Claims, 6 Drawing Sheets

DEVICE FOR EARTH PACKING HAVING AT LEAST ONE VIBRATING ROLLER

BACKGROUND OF THE INVENTION

The invention concerns a device for ground compacting, having at least one vibrating roller whose casing surface is composed of a plurality of segments in a peripheral direction, at least some of which have midpoints which describe an arc having a radius of curvature that deviates from the mean radius of the roller.

Either a vibrating roller or a vibrating plate is used in known devices for ground compacting. The compacting efficiency in vibrating rollers is thereby essentially determined by the line load and the amplitude.

To obtain a high depth effect, as high an amplitude as possible of the vibrating roller is required, whereby it is usually accepted that the higher the amplitude, the higher the depth effect of the compacting.

In recent years, rollers having an increased compacting efficiency were developed, i.e. with high line loads and high amplitudes, which operate with a line load of up to 800 N/m and an amplitude of 2 mm. Rollers of this type have proved to be successful for compacting stony ground not sensitive to shearing stress, since higher fill layers can be compacted.

However, in cohesive ground and/or ground sensitive to shearing stress, the high compacting forces result in the formation of cracks. Essentially, the reason for this is that the high compacting force which acts on the ground via the round roller body, reaches the material to be compacted diagonally which generates high stresses in the surface area and results in cracks and bursts. In contrast thereto, the stresses in deeper ground fade quickly.

In view of the fact that, under these circumstances, the depth effect of ground compacting devices with vibrating rollers is limited, in certain grounds it is preferred to apply the compacting force by flat-surfaced elements, such as e.g. vibrating plates, in which the stress curve in the ground to be compacted is substantially more advantageous since no pronounced stress peaks occur in this case and, moreover, the vertically applied forces fade considerably more slowly in the deeper ground.

Although vibration plates thus compact better than rollers, compacting devices with rollers have found a broader field of application overall due to a higher power area ratio, a greater adaptability and greater climbing ability, better transportability and greater ease of control and they have often superseded plate compactors.

In order to combine the advantages of the vibrating plates with those of the roller, it was, for example, proposed in DE-A 196 48 593 to construct the vibrating roller of the ground compacting device from a plurality of individual segments in the peripheral direction, so that convex curved sections having two different curvatures are formed in the peripheral direction, alternating successively and continuously passing over into one another outward on the tire, whereby the one curvature is stronger and the other curvature is weaker than that of a cylinder defining the outer periphery of the roller. In other words, rollers of this type can also be described as flattened by segment.

It is, moreover, proposed in this publication to provide such segmented flattened rollers in pairs, namely on the front and on the rear axis of a road roller. In this way, it is to be understood that the climbing ability for the road roller is assured because, on the one hand, a tire with a segment having a weak curvature lies on the ground, while the other roller with a segment having a greater curvature simultaneously ensures the advancement of the road roller.

An advantage of this previously known roller is, in particular, that the high loads in the segments having a weak curvature are no longer inserted into the ground to be compacted as line loads with corresponding undesirable side effects, such as unintentional shearing stresses, but that these are greatly reduced since the forces are introduced into the ground via as wide a stand-up surface of the roller as possible. Carrying this idea further results in that the best results should ultimately be obtained if the individual segments of the roller are flat, i.e. its radius of curvature is endless.

Although no shearing stresses occur in the ground to be compacted in this design, the disadvantage is noted in DE-U 296 21 103 that a traction and/or climbing ability is no longer present during a vibration for tires of this type which are presumably known. Moreover, in this publication, a considerably jolting movement is considered a disadvantage for tire surfaces formed from flat sections and it is instead proposed to make the tire surface from sections which have the form of a triangle or trapezoid, wherein adjacent casing sections each have an equally long triangular or trapezoidal side in common and are arranged in such a way that a triangular side or longer trapezoidal side of the adjacent casing surface, opposite a corresponding triangular point or shorter trapezoidal side, is alternately followed by a triangular point or a shorter trapezoidal side of a preceding casing section at the front end of the tires in their peripheral direction.

However, rollers of this type have the disadvantage that their median axis for placing two adjacent casing sections each flat thereon must be tipped in each case which requires an extensive apparatus structure.

Also, in rollers of this type, it is only possible to obtain traction or climbing ability if a comparable second polygonal roller is present on a further axis of a road roller, said second polygonal roller ensuring the forward movement with an edge while a flat section ensures the desired ground compacting on the first-mentioned tire.

In the two previously known road rollers, a good synchronization must be assured for the rotation of the rollers on both axes, as can be seen in the above, said synchronization ensuring the described phase-displaced rotation of the two rollers on the front and rear axes on a continuous basis.

Thus, the object of the present invention is to further develop a roller, as described above, in such a way that it has as good an automatic synchronization as possible. Moreover, a possibility should be given to make it possible to omit the extensive synchronization of the front and rear axes when using two rollers on a road roller.

BRIEF SUMMARY OF THE INVENTION

According to the invention, this object is solved by a corresponding roller that has several adjacent sections in an axial direction consisting of segments abutting one another in a peripheral direction and which have abutting edges displaced vis-à-vis one another in the peripheral direction.

The advantage of these rollers lies therein that their "rolling behavior" is improved considerably. At the same time, the compacting and the advancement and/or climbing ability can be realized with only one roller. Moreover, the effect of the sections arranged so as to be displaced vis-à-vis one another in the peripheral direction is to reinforce the individual segments, as a result of which an even more improved transmission of the vibration forces to the ground material to be compacted is obtained.

Preferably, corresponding rollers have between 2–7 corresponding adjacent sections.

To obtain a compacting that meets the requirements, it is proposed to provide the vibrating roller with a directional vibrator which can, if necessary, be adapted to the ground in the direction of and/or the amplitude of its vibrating force.

In this connection, it is furthermore proposed to turn the roller intermittently via a stepped gear, whereby this stepped gear can, for example, be coupled with a device for detecting a vibration speed of the directional vibrator. It is thus ensured that a given vibration speed is applied to each ground section on which the roller comes to rest with a flattened segment and to thus ensure a desired compacting result.

It is also possible to couple the stepped gear with a device to move the vibrating roller, said device directly determining the ground compacting by means of various parameters and, when a set value is reached, to then actuate the stepped gear to shift it to a next segment.

Finally, with a compacting device of this type which moves forward intermittently, it is ensured that the contact time of the flattened vibrating segments is sufficient in each case for the desired compacting result.

Surprisingly, it is also possible to ascertain very good compacting results if the individual segments have a slightly concave slope directed to the roller axis.

Furthermore, it was found that the climbing ability was even more improved when the abutting edges of the flattened segments were provided with serrated slats protruding in a radial direction which can, moreover, be made of a harder material and thus reduce wear which is greater at this point.

To eliminate the impressions which are caused by the polygonal points in the ground to be compacted and which can be seen at the abutting edges between individual segments of a section in the roller cross section, it is, moreover, proposed to equip the compacting devices with a smooth roller surface with which the undesirable surface structure can be subsequently compacted and smoothed.

In addition, it is also proposed to provide a roller with circular cylindrical sections. In particular, this enables a very quiet mode of travel, especially on approaching and departing paths that run on Roads. Preferably, these circular sections are here provided in the vicinity of the axial ends of the roller in order to increase the stability of the compacting device.

BRIEF DESCRIPTION OF THE SEVERAL VIEWS OF THE DRAWINGS

Further advantages and features of the invention can be found in the following description of embodiments, showing.

DETAILED DESCRIPTION OF THE INVENTION

Figure 1:
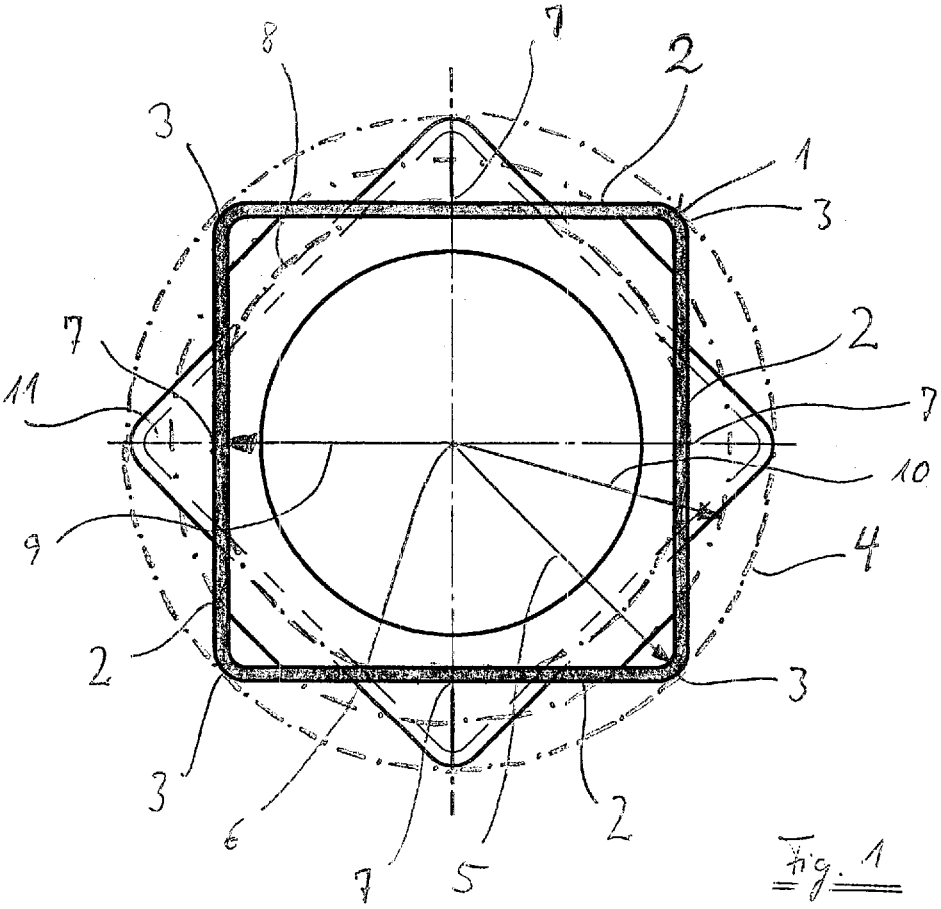
FIG. 1 is a side view of a vibrating roller having a casing surface consisting of four segments.

FIG. 1 shows a roller for a ground compacting device from a side view. This roller has a casing surface 1 which is composed of four segments 2 in the peripheral direction of the roller. These segments 2 abut one another at edges 3.

When the roller is rotated, the edges 3 describe a circular arc 4 whose radius of curvature 5 corresponds to the distance of the edges 3 from the roller axis 6. In a similar manner, the central points 7 of the segments 2 describe a circular arc 8 whose radius of curvature 9 corresponds to the distance of the central points 7 from the roller axis 6. Accordingly, the mean roller radius 10 lies between the radius of curvature 9 of the circular arc 8, described by the central points 7, and the radius of curvature of the circular arc 4 described by the edges 3.

During vibration, a roller with a cylindrical surface not only applies normal forces on a ground to be compacted but also shearing stresses which, depending on the ground, are very undesirable. To prevent these, the segments 2 shown here are configured flat, i.e. they extend in the axial direction of the shaft parallel to the shaft axis and otherwise lie in a tangential plane. In this way, only normal forces are transmitted by the segment when it is on the ground to be compacted, but no shearing stresses. As a result, forces required for the forward movement of the roller can also not be applied parallel to the ground level via a segment of this type.

It should thereby be understood that the shearing forces applied by the vibrating device to the ground are essentially already reduced with a decrease in the deflection of the segments 2 and disappear with the flat configuration of the segments 2 as illustrated. One should thereby proceed on the basis that the vibration forces are applied by vibrations in the vertical direction.

By a rolling turn of the roller over an edge 3 until the adjacent segment 2 is in horizontal alignment, a more or less continuous working of the ground can be obtained in that one surface section after another is compacted by segments acting on these surface sections. The advancement is thereby activated by the edge 3 when it rolls on the ground.

Since the roller axis 6 is raised and lowered again by a considerable path in, for example, a compacting roller provided with only four segments over its entire width during "rolling" over an edge 3 of the roller axis 6, a similar further section 11 is added axially adjacent to the first section having four segments, shown as a black frame in the sectional view, said further section 11 being displaced with its four abutting edges on the comers by 45° vis-à-vis the first section with its abutting edges 3. As a result, the lifting movement of the roller axis 6 can be reduced, on the one hand, and a forward movement is also ensured with only one roller; while one section lies flat on the ground with a segment in order to compact it, the advancement required for the forward movement is ensured by the adjacent section which has an edge pressed onto the ground, whereby forces are also transmitted parallel to the ground level via the segments adjoining the edge and then standing diagonally.

Figure 2:
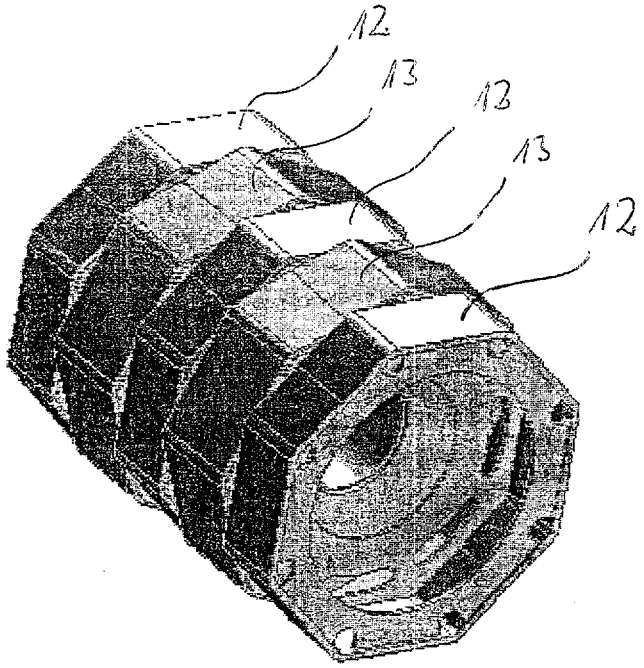
FIG. 2 is an oblique view of a roller having a casing surface consisting of eight segments in five sections.
Figure 3:
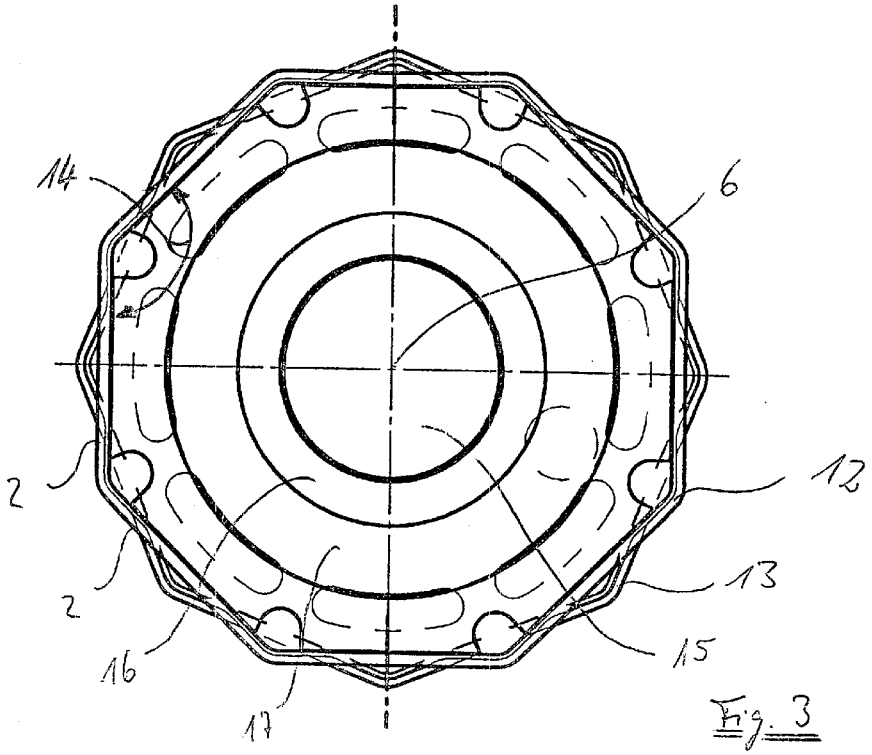
FIG. 3 is a side view of a roller according to FIG. 2.

For this purpose, a roller is shown in FIG. 2 in which a total of five sections 12 and 13 are arranged adjacent to one another over its width. As can be seen in FIG. 3, these sections each consist of eight flat segments 2 on their casing surface.

The flat segments each abut one another in the peripheral direction without forming an undercut. That is, the angle 14 shown in FIG. 3 is always less than 180° in adjacent segments.

Figure 4:
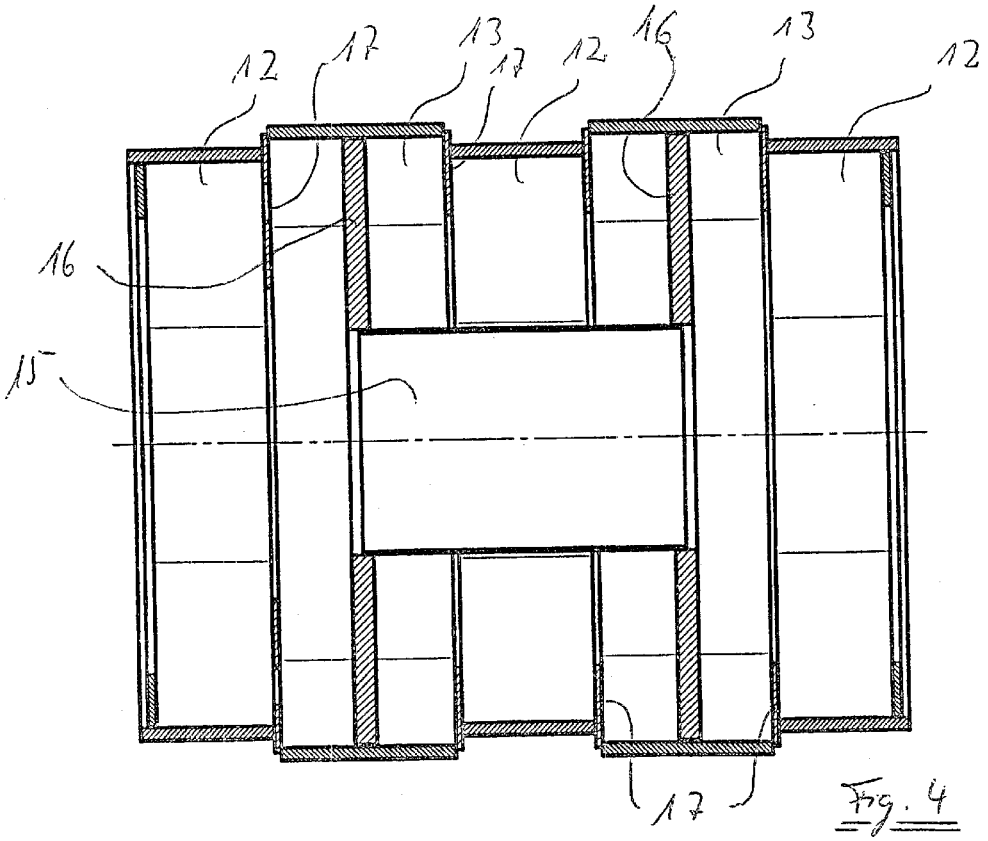
FIG. 4 is a sectional view of a roller according to FIG. 2.

In FIG. 4, a longitudinal section through a roller according to FIG. 2 is shown. It can be seen that it has a hub 15 in the center which supports, on its axial ends, the surface of the roller consisting of several segments via hub plates 16.

The individual sections 12, 13 are thereby limited in the axial direction of the roller by means of perforated plates 17 by which adjacent sections are also added, and which are displaced by an angle in the peripheral direction.

These perforated plates 17 thereby result in a reinforcement and stabilization of the individual segments 2 supported by them on their edges.

It can be seen in FIG. 3 that a considerably slighter lifting movement must be carried out when the roller with eight segments shown there rolls over the periphery of the roller axis 6 when changing from a first flat segment 2 to an adjacent flat segment 2 than in the embodiment shown in FIG. 1 which has only four segments over the periphery. Moreover, an even more uniform advancement is made possible.

Figure 5:
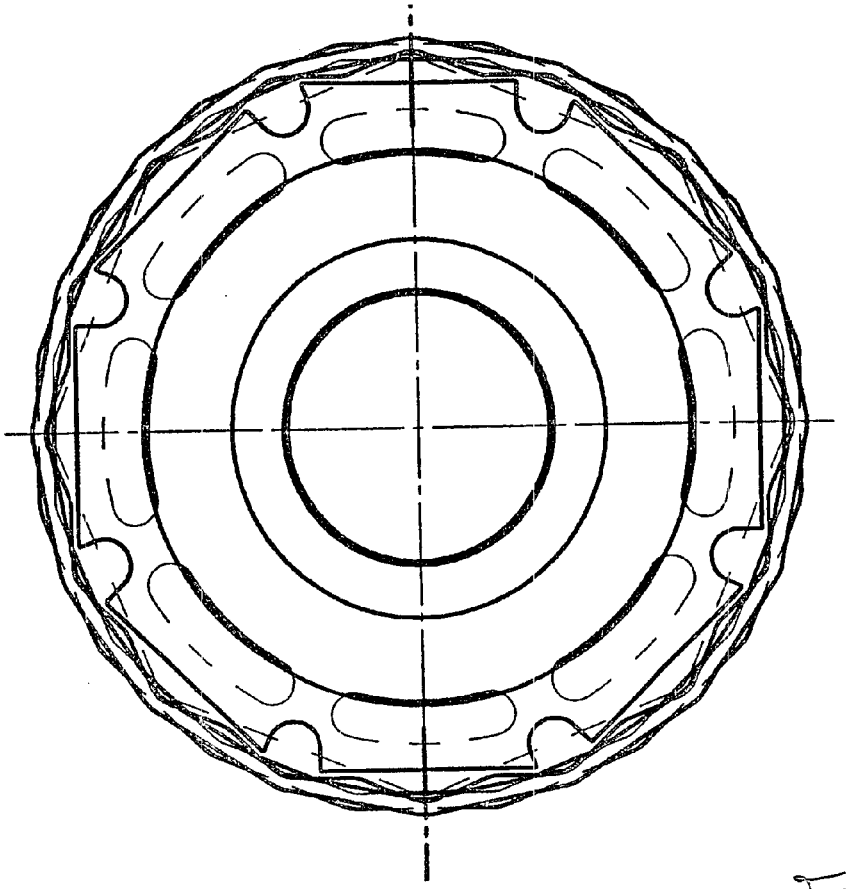
FIG. 5 is a side view of a roller having a casing surface consisting of 16 segments.

An even greater equalization of the lifting movement to a lesser degree is obtained when a total of 16 flattened individual segments form the casing surface 1, as shown in FIG. 5, over the periphery of a roller. One essentially always proceeds on the basis that adjacent sections are present which are always advantageously displaced with the abutting edges of their segments by half an angle between the abutting edges of the adjacent section.

A directional alignment vibrator is then advantageously installed in the hub 15 whereby, after a pre-set number of vibrations by means of a gear shift transmission (not shown), the roller is turned by the aforementioned half angle in such a way that a further segment, arranged on the adjacent section, is applied flat to the ground and is acted upon by vibrations to compact the ground. During this shifting, the roller travels over the abutting edges, also on ascending terrain, etc.

Figure 6:
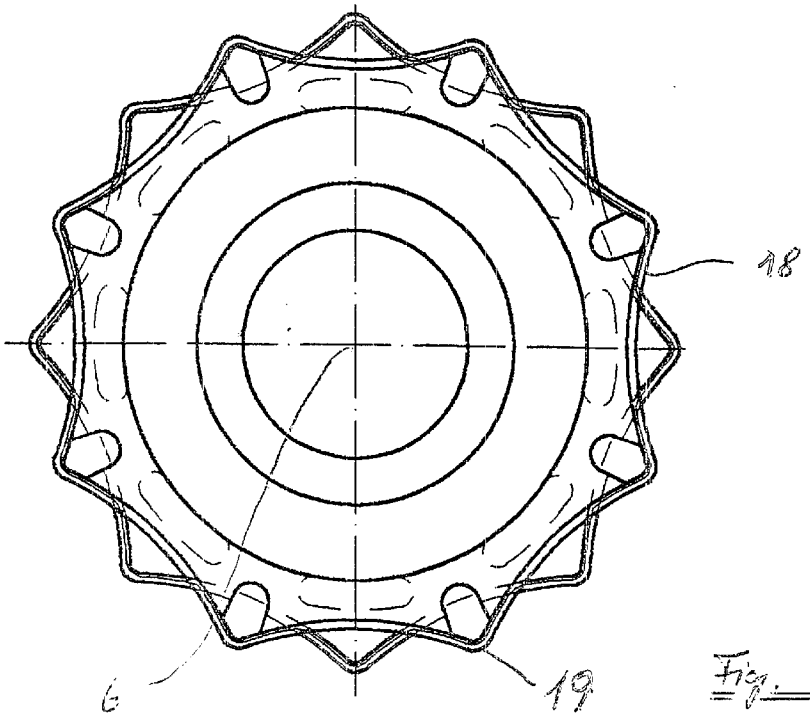
FIG. 6 is a side view of a roller having a casing surface consisting of eight concave segments.

A roller with a specially configured type of segments is shown in FIG. 6. The individual segments 18 have a concave shape, i.e. they are curved in direction of the roller axis 6. Due to this type of a concave design of the segments, a kind of "focussing" of the vibration forces can be obtained on deeper-lying ground layers. In this case, the especially strong protruding edges 19 are used for the advancement which, due to their form, are well suited for starting the movement of the roller.

Figure 7:
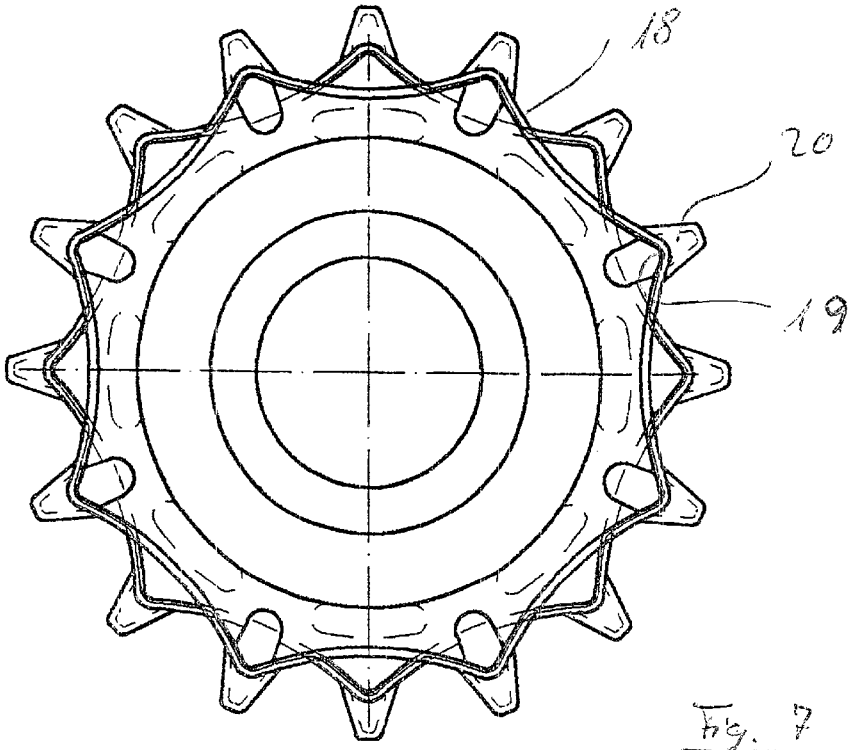
FIG. 7 is a side view of a roller having a casing surface consisting of eight concave segments and having serrated slats on the abutting edges.

To prevent greater wear occurring on these edges 19 in this case, serrated slats 20 are mounted on these edges 19, as can be seen in FIG. 7, which are composed of a wear-resistant material and thus protect the edges 19. The serrated slats 20 thereby each extend over the width of a section.

With these types of rollers also, it is proposed to turn them further by means of a gear shift transmission after a pre-set number of vibrations in order to in this way obtain the advancement and compacting at other points.

In this case, it is also basically possible to make the number of vibrations applied to the ground with a segment dependent on the compacting result by coupling the gear shift transmission with a corresponding device for determining the ground compacting.

Figure 8:
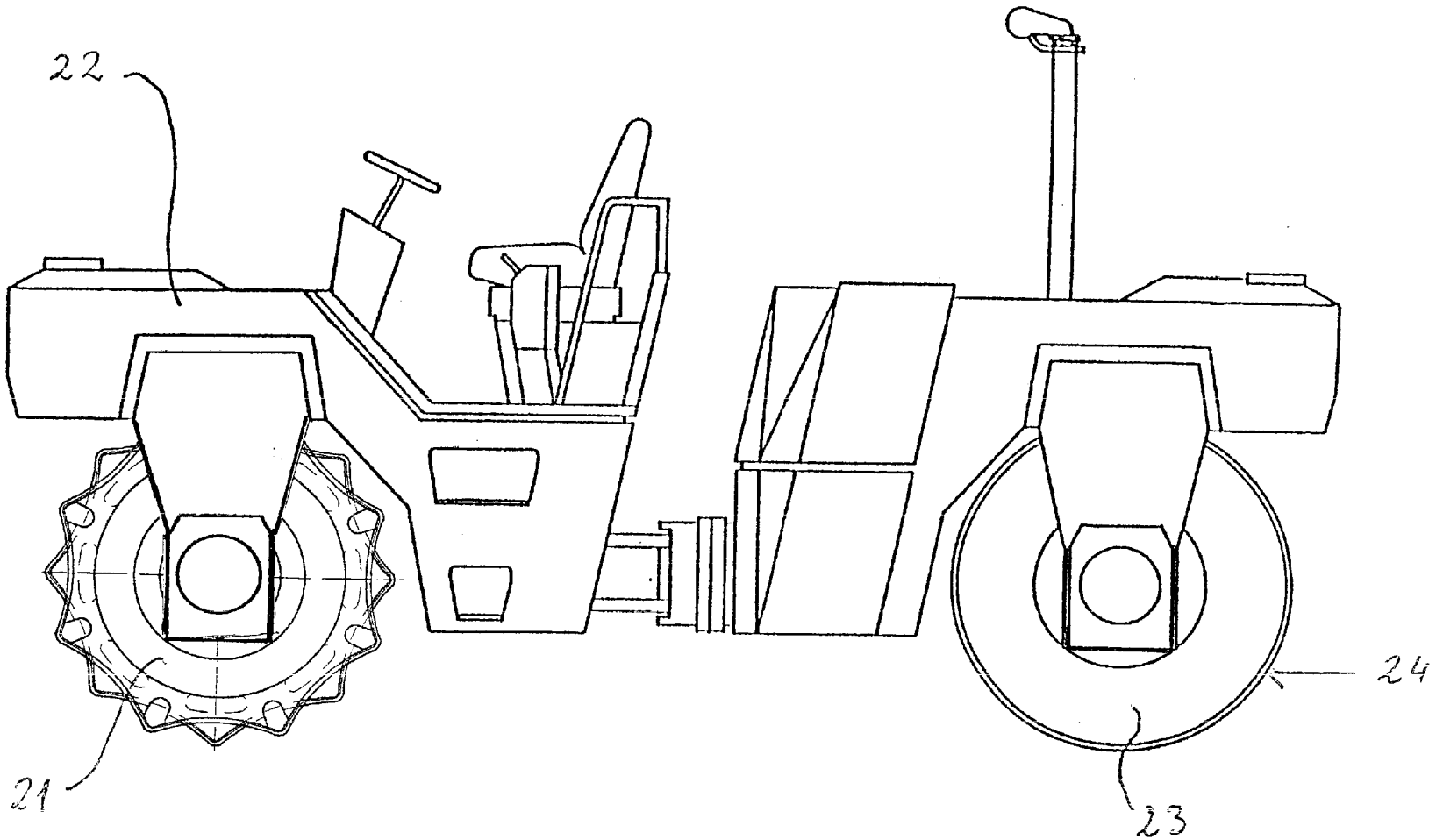
FIG. 8 is a side view of a compacting device with a vibrating roller according to the invention.

A corresponding compacting roller 21 according to FIG. 6, installed in a corresponding compacting device 22, can be seen in FIG. 8. This compacting device 22 has an additional roller 23 which is provided with a smooth casing surface 24. Since the additional roller 23 with the smooth surface 24 of the compacting device 22 follows the compacting roller 21 precisely, a subsequent compacting of the surface structure left by the compacting roller 21 can be obtained with this additional roller 23, whereby this surface structure produced by the compacting roller 21 is also smoothed by the smooth casing surface 24.

Figure 9:
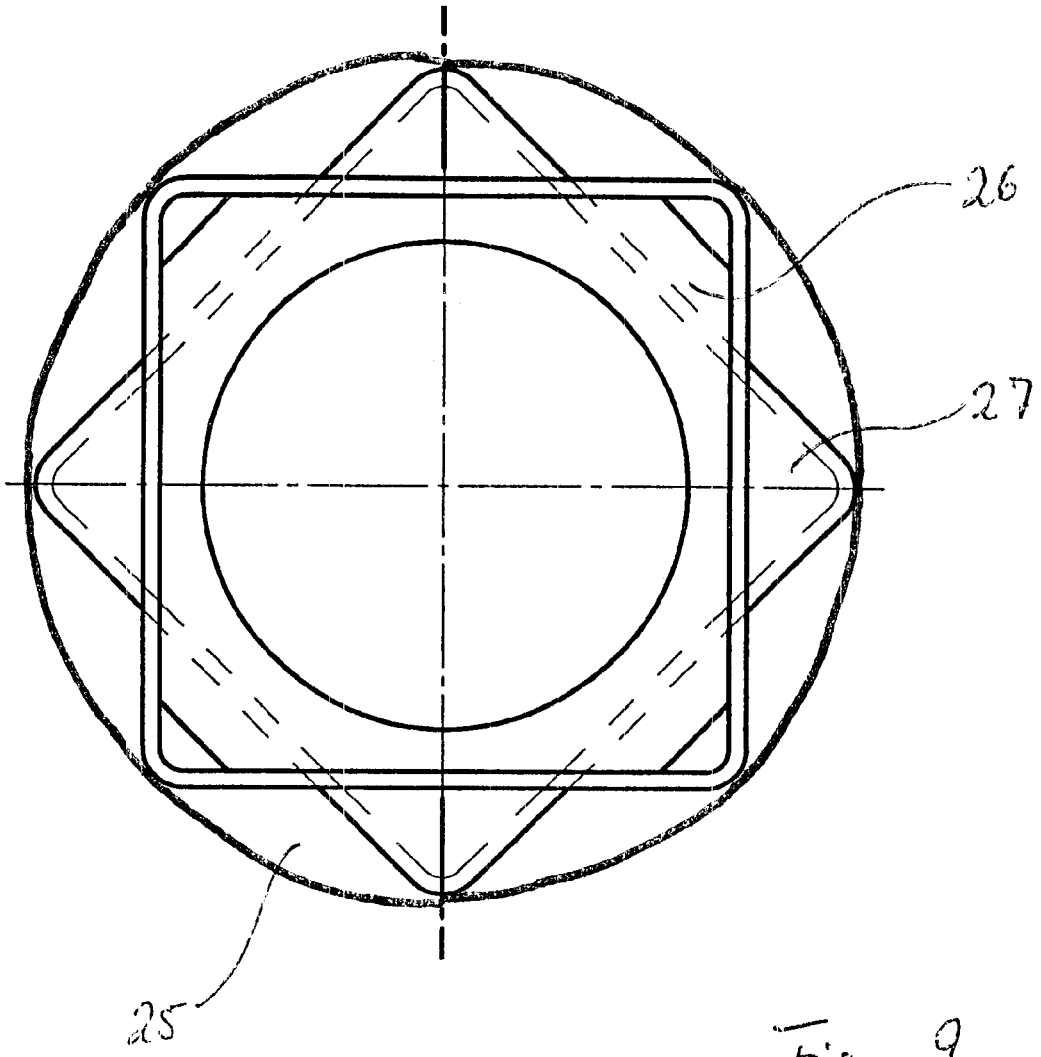
FIG. 9 is a side view of a vibrating roller with circular cylindrical sections.

Lastly, it should also be pointed out in FIG. 9 that rollers, as shown in FIGS. 1–7, can also be provided with sections 25 which have a circular cylindrical form. A circular cylindrical section 25 of this type, arranged in the axial direction beside or between sections 26, 27 with flattened segments, enables a device, as shown in FIG. 8, to travel more quietly, particularly when approaching or leaving a work site. In this case, these circular sections are preferably provided in the vicinity of the axial ends of the roller, resulting in increased stability of the compacting device. From the side view, a roller of this type with circular cylindrical sections then appears as in the roller 23 shown in FIG. 8, in which a casing composed of individual sections with flattened segments can also be provided instead of the smooth casing 24.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A ground compacting device comprising at least one vibrating roller with a central shaft axis, the at least one roller having a casing surface comprising a plurality of sections lying adjacent one another in an axial direction of the at least one roller, at least some of the sections having a plurality of segments lying end to end in a peripheral direction of the at least one roller and each segment having a dimension extending in the axial direction parallel to said shaft axis, wherein there are substantially no gaps in the axial direction between segments of adjacent sections, the segments of the at least some sections abutting each other in the peripheral direction of the at least one roller at edges which are always displaced in a peripheral direction from abutting edges of an adjacent section, each segment having a major surface and having midpoints which are disposed on a radius which is less than a mean radius of the at least one roller, such that ground compaction is effected by normal forces transmitted by the major surfaces when they contact the ground, wherein at least two sections of the plurality of sections each have a plate, so that the individual sections provide a peripheral continuous roller surface and the at least one roller is at least partially supported and stabilized by the plates and the sections.

2. The ground compacting device according to claim 1, wherein the major surfaces of the segments lie in respective tangential planes of the at least one roller.

3. The ground compacting device according to claim 1, wherein the major surfaces of the segments have a slightly concave slope directed toward the shaft axis of the at least one roller.

4. The ground compacting device according to claim 1, wherein each section of the at least one roller has four to sixteen segments.

5. The ground compacting device according to claim 1, wherein the abutting edges are provided with serrated slats.

6. The ground compacting device according to claim 5, wherein the serrated slats comprise a wear-resistant material.

7. The ground compacting device according to claim 1, wherein the at least one roller has two to seven sections.

8. The ground compacting device according to claim 7, wherein the at least one roller also has at least one section which is circular in cross-section.

9. The ground compacting device according to claim 8, wherein two circular sections are arranged on axial ends of the at least one roller.

10. The ground compacting device according to claim 1, further comprising an additional roller provided with a smooth casing surface.

11. The ground compacting device according claim 1, wherein the adjacent sections are connected to one another by the plates.

12. The ground compacting device according claim 1, wherein the plates have a hub in the center that supports the sections.

13. The ground compacting device according claim 1, wherein the plates are perforated.

14. The ground compacting device according to claim 1, wherein said major surface has a flattened shape.

15. The ground compacting device according to claim 1, wherein said major surface has a concave shape.

* * * * *